US008545677B2

(12) United States Patent
Svenka et al.

(10) Patent No.: US 8,545,677 B2
(45) **Date of Patent: *Oct. 1, 2013**

(54) CALENDER FOR TREATING A PRODUCT WEB

(75) Inventors: Peter Svenka, Grefrath (DE); Bernhard Brendel, Tönisvorst (DE); Eduard Davydenko, Grefrath-Oedt (DE)

(73) Assignee: Andritz Kusters GmbH, Krefeld (DE)

( * ) Notice: Subject to any disclaimer, the term of this patent is extended or adjusted under 35 U.S.C. 154(b) by 7 days.

This patent is subject to a terminal disclaimer.

(21) Appl. No.: 13/380,011

(22) PCT Filed: Jun. 25, 2010

(86) PCT No.: PCT/EP2010/003899

§ 371 (c)(1),
(2), (4) Date: Dec. 21, 2011

(87) PCT Pub. No.: WO2011/000529

PCT Pub. Date: Jan. 6, 2011

(65) Prior Publication Data

US 2012/0090801 A1 Apr. 19, 2012

(30) Foreign Application Priority Data

Jun. 30, 2009 (EP) ..... 09008507

(51) Int. Cl.
*D21G 1/00* (2006.01)
*B30B 5/04* (2006.01)

(52) U.S. Cl.
USPC ..... 162/358.5; 162/360.2; 100/153

(58) Field of Classification Search
USPC ..... 162/358.1, 358.2, 359.1, 358.5, 360.3, 162/361, 205, 206; 100/151, 153, 155 R, 100/160, 161, 162 R, 306
See application file for complete search history.

(56) References Cited

U.S. PATENT DOCUMENTS 4,596,633 A * 6/1986 Attwood ..... 162/206
5,836,242 A * 11/1998 Aberg ..... 100/327
2003/0101880 A1* 6/2003 Koivukunnas et al. ..... 100/161

FOREIGN PATENT DOCUMENTS

DE 102007024581 * 11/2008
DE 102007024581 A1 11/2008

(Continued)

OTHER PUBLICATIONS

JP 2001-316996, Nov. 2001, Derwent Abstract (English language).*

(Continued)

*Primary Examiner* — Eric Hug
(74) *Attorney, Agent, or Firm* — Kilpatrick Townsend & Stockton LLP

(57) ABSTRACT

Calender (1) for calendering a paper or board web (2), having at least one nip (3), which is formed between a heatable roll (4) and a mating element (5), a device (6) for producing a predetermined pressure in the nip (3), and a web treatment device (7) arranged upstream of the nip (3) and having two contact surfaces (9, 10) forming a treatment nip (8), one of which is a circulating contact surface (9) which is formed by a belt (14) circulating on guide rolls (11, 12, 13), the other contact surface (10) is formed by the circulating surface of the heatable roll (4), and the treatment nip (8) extends along an angle (15) of the wrap of the heatable roll (4), wherein, in order to increase the thermal efficiency of the transfer of heat, the circulating belt (14) uses a resilient surface to press the paper or board web (2) onto the heatable roll (4), and the guide rolls (11, 12, 13) control sectional forces of the circulating belt (14) in the treatment nip (8).

22 Claims, 4 Drawing Sheets

(56) References Cited

FOREIGN PATENT DOCUMENTS

| | | | | |
|---|---|---|---|---|
| EP | 0141614 | A2 | | 5/1985 |
| EP | 0532455 | | * | 3/1993 |
| EP | 0886695 | B1 | | 5/2002 |
| EP | 1314821 | A2 | | 5/2003 |
| EP | 1478805 | B1 | | 3/2008 |
| JP | 8-199465 | | * | 8/1996 |
| JP | 2001-316996 | | * | 11/2001 |
| WO | WO01/71091 | A1 | | 9/2001 |
| WO | WO/01/98585 | A1 | | 12/2001 |

OTHER PUBLICATIONS

JP 2001-316996, Nov. 2001, English language machine translation [retrieved from Internet, http://www.ipdl.inpit.go.jp/homepg_e.ipdl].*

JP 8-199465, Aug. 1996, Derwent Abstract (English language).*

JP 8-199465, Aug. 1996, English language machine translation [retrieved from Internet, http://www.ipdl.inpit.go.jp/homepg_e.ipdl].*

DE 102007024581, Nov. 2008, Derwent Abstract (English language).*

DE 102007024581, Nov. 2008, English language machine translation [retrieved from Internet, http://worldwide.espacenet.com/?locale=en_EP].*

EP 0532455, Mar. 1993, Derwent Abstract (English language).*

EP 0532455, Mar. 1993, English language machine translation [retrieved from Internet, http://worldwide.espacenet.com/?locale=en_EP].*

* cited by examiner

Fig. 3
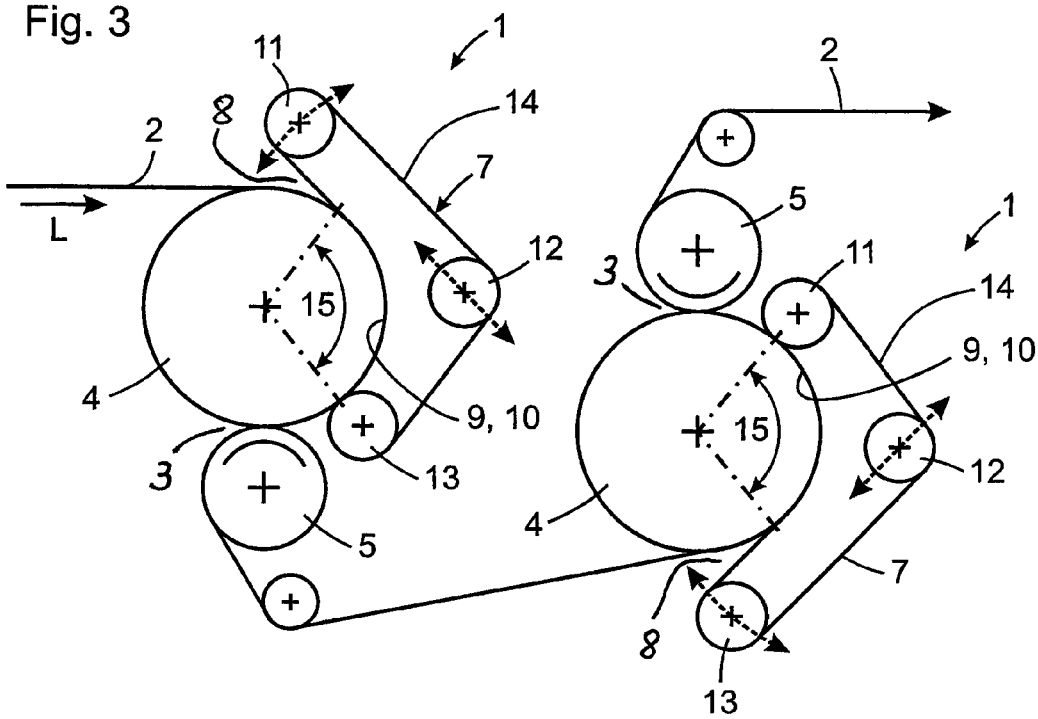
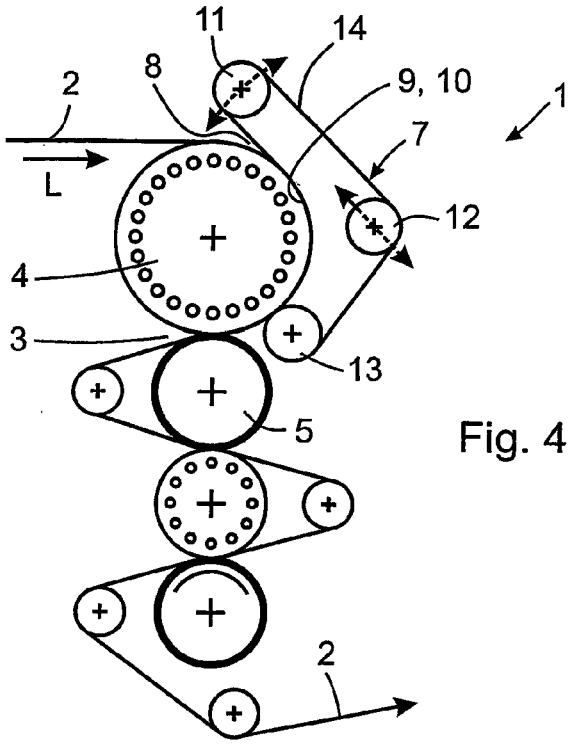
Fig. 4

CALENDER FOR TREATING A PRODUCT WEB

The invention relates to a calender for calendering a paper or board web, according to the pre-characterizing clause of claim 1.

In order to improve the surface quality, paper or board webs are calendered. The loss of volume which occurs at the same time is usually undesired. In order to carry out the calendering with the greatest possible maintenance of the volume, use is made of calenders with an extended nip. To this extent, one also speaks of a broad nip.

WO 01/98585 A1 discloses the use of shoe calenders having nip widths between 50 mm and 70 mm and operation with line loads up to 400 N/mm. The volume-maintaining calendering attained in this way is achieved by means of a long dwell time in the nip with a high roll temperature above 200° C. to 300° C. The low temperature resistance of the belt requires a great deal of effort in order to protect the said belt from burning. Furthermore, the high roll temperatures give rise to high operating costs. Because of the requirement for cross-machine thickness profile control with simultaneous calendering of the surface, a further hard nip or soft nip calender is necessary when using the shoe calender. This gives rise to considerable costs and leads to a reduction in the advantages of volume-maintaining calendering as a result of the thickness reduction caused by the additional nip.

EP 0 141 614 A2 discloses a method for calendering a paper or board web in which the extended nip is formed between a heatable roll and a circulating belt. The belt rests on the heatable roll along a wrap section. Guide rolls for the circulating belt control the pressure loading in the extended nip via the belt tension and the use as pressure rolls. Roll temperatures of 120° C. to 315° C. are, however, also required here for the calendering.

EP 1 478 805 B1 discloses a device for drying a fibrous web, which can be used at the same time for calendering. To this end, a metal belt calender with an extended nip is provided. By means of the belt tension, a surface pressure of about 0.01 MPa is maintained. Both the roll and the metal belt can be heated, so that both sides of a web can be calendered. The use of the metal belt in this case permits the application of elevated temperatures of more than 100° C. and even as high as about 400° C. This elevated temperature, together with a long application time and a wide pressure control range, yields a good calendering result. However, because of the metal belt, the effects correspond to those of a hard nip calender, which means that the web has a tendency to mottling. The use of high temperatures is once more expensive in terms of costs and energy.

DE 10 2007 024 581 A1 discloses a calender and a method for supercalendering in which two extended nips formed with circulating belts are interrupted by at least one shorter nip. In this case, the shorter nip generally has a higher pressure applied. The first extended nip is used substantially to supply heat. The short press nip causes a calendering impulse on the web. The second extended nip is used to even out the calendering effect while at the same time cooling the web. Preference is given to a metal belt which, because of the high thermal conductivity, can be advantageous for the input of heat. The application of high temperatures of up to 300° C. is envisaged, this applying in particular to the first extended nip. Consequently, the disadvantages of high temperatures already described also have to be accepted here.

The object of the present invention is to devise a calender which calenders a paper or board web in a volume-maintaining manner and can be operated in a way that saves costs and energy.

This object is achieved by the features of claim 1.

In this way, a calender is devised in which the paper or board web, before entering the nip, runs through a pre-treatment section to produce an optimal temperature profile during the calendering in the nip. The roll surface temperature of the heatable rolls needs to be chosen to be only slightly higher than the plasticization temperature of the respective paper or board web at a selectable moisture content. For instance, it is possible to carry out calendering at a roll surface temperature which, in this respect, is higher by only 10-30° C. As a result, the increase in the calendering effect is possible in soft calenders, multi-nip calenders and calenders having extended nips.

The prolonged dwell time in conjunction with the resilient surface of the circulating belt improves the heating of the paper or board web considerably. Good heat transfer is ensured, since the paper or board web is pressed uniformly onto the heatable roll, so that, for example, air cushions which could hinder the transfer of heat are largely avoided. The advantages to the calender proposed therefore result from the extended dwell length for heating the web in conjunction with the structure of the circulating belt, which forms a contact surface of the treatment nip.

As a result of prolonged heating of the paper or board web in the treatment nip, uniform heating of the paper or board web down to the technologically required depth is possible. For this purpose, roll surface temperatures in the range from 80° C. to 160° C. are generally adequate. The level of the temperature is reduced to the benefit of a prolongation of the time interval of the temperature action. The reduction in the level of the temperature for the thermal-mechanical calendering operation is then substantially determined only by the plasticization temperature of the fibrous materials used for a paper or board web and the moisture content of the latter. The resilient surface of the belt ensures a uniform contact pressure in this case and therefore a uniform transfer of heat from the heated roll to the paper or board web.

The contact pressure is set by the tension of the belt. This tangential tensioning of the belt loads the belt, which is normally composed of a plastic, a rubber, a plastic-coated carrier material or a rubber-coated carrier material, far less than radial loading. In the case of radial loading, the plastic exhibits a tendency to delamination of a layer composite. The thermal stressing of the belt is low, so that the belt has a long lifetime.

Volume-maintaining calendering is therefore achieved with a treatment nip placed upstream of a nip, the belt of the said treatment nip having a resilient or soft surface on the side facing the paper or board web, this treatment nip being operated in the manner of an extended nip in the low-temperature range from, for example, 80° C. to 160° C., as opposed to the known extended nips. The energy saving resulting from this results from reduced thermal radiation and reduced forcible convection.

The nip then following the extended nip for pre-calendering can be operated with high compressive stresses, since the penetration depth of the (excess) heat into the paper or board web, which is lacking at low temperatures, rules out the effect of the calendering on regions of the paper or board web that are located deeper in. The latter remain resilient.

The greatest possible volume maintenance is provided. The efficiency of the transfer of heat is increased, so that the extent of heat loss is reduced.

With the calender according to the invention, it has been possible to realize the advantages and the effects to be expected from the simultaneous use of pressure and temperature in the nip in a manner saving costs and energy.

The heat loss is reduced considerably in particular when the circulating belt has a closed surface cover on the side facing the paper or board web. The thermally sealing and shielding effect of the circulating belt on the paper or board web in the treatment nip is increased. A further increase can be achieved through the material of the resilient surface, which is able to act as a thermal insulator. To this end, this material preferably has a low thermal conductivity.

A dwell time in the treatment nip which is required to achieve the desired penetration depth of the heat can be optimized by adjusting the contact length of the belt on the circumference of the heatable roll by means of guide rolls.

The mating element forming the nip is preferably arranged directly after the treatment nip on the heatable roll. Preference is given to the use of a deflection controlled roll for the simultaneous control of the property profile of the web in the cross direction. The mating element can be a soft roll or a hard heatable roll if calendering of both sides is desired. The line load can be matched to the respective objective.

The calender can have one or more nips; in the case of a plurality of nips, the treatment nip is preferably arranged before the first nip.

A controlled increase of pressure in the treatment nip can preferably be set by guide rolls for the circulating belt additionally operating as pressure rolls.

Further refinements of the invention can be gathered from the following description and the subclaims.

The invention will be explained in more detail below by using exemplary embodiments illustrated in the appended drawings, in which:

FIG. 3 shows, schematically, an arrangement of two calenders according to a second exemplary embodiment, FIG. 4 shows, schematically, a calender according to a third exemplary embodiment.

Figure 1:
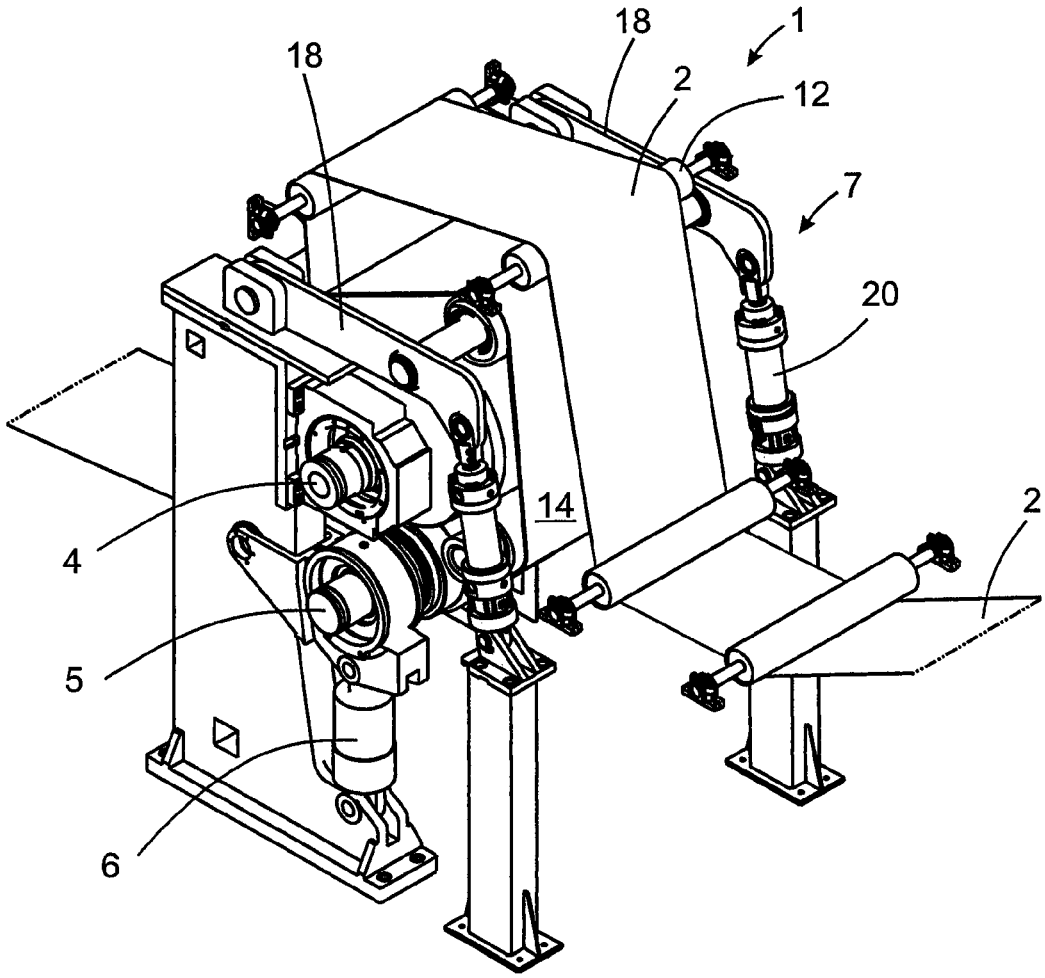
FIG. 1 shows, schematically, a perspective view of a calender.

The invention relates to a calender 1 for calendering a paper or board web 2, having at least one nip 3 which is formed between a heatable roll 4 and a mating element 5. The mating element 5 is preferably a roll, in particular a deflection controlled roll, for the simultaneous control of the property profile of the web 2 in the cross direction. The mating element 5 is preferably a soft roll. Alternatively, the mating element 5 is constructed as a hard roll, which is then preferably heated, in order to be able to calender the paper or board web 2 on both sides. The nip length of the nip 3 preferably lies in the range from 1 to 40 mm, depending on the type of the mating element 5, e.g. hard roll, soft roll or shoe roll. The roll 4 and also the mating element 5 can be driven in each case, in particular for the online operation of the calender. The heatable roll 4 is heated to roll surface temperatures of 80° C. to 160° C., for example, depending on the plasticization temperature of the respective paper or board web 2 and the moisture content of the latter.

The calender 1 comprises a device 6 for producing a predetermined pressure in the nip 3. By way of example, the device 6 for producing a predetermined pressure here is a loading cylinder. Alternatively or additionally, the mating element 5 can be constructed with an internal stroke, by which means a pressure loading in the nip 3 can be established.

Arranged upstream of the nip 3 in the web running direction L is a web treatment device 7 having two contact surfaces 9, 10 forming a treatment nip 8. The contact surface 9 is a circulating contact surface, which is formed by a belt 14 circulating on guide rolls 11, 12, 13. The other contact surface 10 is formed by the circulating outer wall of the heatable roll 4. The treatment nip 8 extends along an angle 15 of the wrap around the heatable roll 4. The angle 15 of the wrap for varying the length of the treatment nip 8 can be adjusted as a function of a desired penetration depth of the heat into the paper or board web 2. By adjusting the contact length of the belt 14 on the circumference of the heatable roll 4, the selectable dwell time is optimized by means of the guide rolls 11, 12, 13. The contact length on the circumference of the roll 4 can preferably be set variably from 0.25 to 2.5 m.

In order to increase the thermal efficiency of the transfer of heat, the circulating belt 14 presses the paper or board web 2 onto the heatable roll 4 with a resilient surface. The guide rolls 11, 12, 13 control sectional forces of the circulating belt 14 in the treatment nip 8.

The contact pressure in the treatment nip 8 is set via the tension of the belt 14. The maximum tensile stress of the belt 14 is limited to preferably 200 kN/m. The compressive stress that can be achieved in the pre-treatment zone of the treatment nip 8 can, for example, reach a value in the range from 0.01 MPa to 0.5 MPa. This depends on the belt tension and the dimensions of the heatable roll 4.

Before entering the treatment nip 8, the web 2 can wrap around a portion of the heatable roll 4.

The surface temperature of the heatable roll 4 is preferably controlled in such a way that, within the dwell time of the web 2 underneath the belt 14, the glass transition temperature is achieved in a penetration depth that is optimal for the respective objective of the calendering operation. For volume-maintaining calendering, such heating is required only down to a depth of about 10 μm. The surface temperature and the length of the pre-treatment section of the treatment nip 8 are optimized in such a way that operation is made possible at a temperature which does not substantially exceed the glass transition temperature of the surface region of the web 2 that is to be plasticized. The web 2 pre-treated in this way, which can previously be moistened with nozzle and/or steam moisteners before the calender 1, is calendered directly after the pre-treatment section in the nip 3, in particular a soft or hard nip. The mating element 5 forming the nip 3, preferably a roll, is arranged on the heatable roll 4 immediately after the wrapped section. Moistening after the calender 1 or between two calenders 1 is also possible, if this is technologically necessary.

If the mating element 5 is a roll, then its diameter is preferably less than or equal to 90% of the diameter of the heatable roll 4. In this way, the distance between the end of the treatment nip 8 and the entry to the nip 3 is intended to be kept as small as possible.

The circulating belt 14 has a resilient surface to ensure a uniform contact pressure, which can be set via the tension of the belt 14. For a thermal action of the belt 14 on the paper or board web 2, the circulating belt 14 has a resilient surface which has a closed surface cover on the side facing the paper or board web 2. The heat transfer originating from the heated roll 4 to the paper or board web 2 is shielded thermally with respect to the surroundings in the treatment nip 8 by the circulating belt formed in this way. The initiation of the heat into the paper or board web 2 is improved, since dissipation of heat to the surroundings is reduced. If the resilient surface is a thermal insulator, the initiation of the heat into the paper or board web 2 is improved further. The resilient surface of the circulating belt 14 therefore preferably consists of a material having a thermal conductivity less than or equal to 10 W/mK, in particular less than or equal to 5 W/mK, entirely preferably less than or equal to 1 W/mK. The belt 14 preferably consists of a material having a thermal conductivity less than or equal to 1 W/mK. The hardness of the resilient surface preferably lies in the range from 50 Shore A to 92 Shore D.

The belt 14 preferably comprises a flat carrier material which is provided with one or more resilient layers. Such a plastic composite material has a high tensile strength. In order to increase the mechanical strength of the belt, a supporting fabric or supporting belt can be incorporated. Furthermore, the circulating belt 14 can comprise a carrier material provided with a resilient layer, it being possible for the carrier material also to consist of a metal. Given a sufficiently thin resilient layer, the hardness of the metal can ensure calendering of the side of the paper or board web 2 facing the circulating belt 14. The roughness of the resilient surface of the belt 14 preferably lies in the range from 0.5 to 5 μm. The smoothness of the resilient surface of the belt 14 which is then provided can be imaged as smoothness on the paper or board web 2. The belt 14 has, for example, a heat-resistant surface coating, for example of silicone. The heat-resistant coating supplies high wearing resistance and a smooth surface.

The pre-treatment section of the treatment nip 8 is in particular also used for pre-calendering the web 2.

Furthermore, the circulating belt 14 preferably exhibits only little stretch, which is less than or equal to 7%. The stretch occurring on account of tensile stress in the belt 14 during the setting of the belt tension in the belt 14 then does not interfere with the calendering. The belt 14 has at least the same width as the web 2. The thickness of the belt 14 depends on its width and length and can be between 4 and 20 mm.

Figure 2:
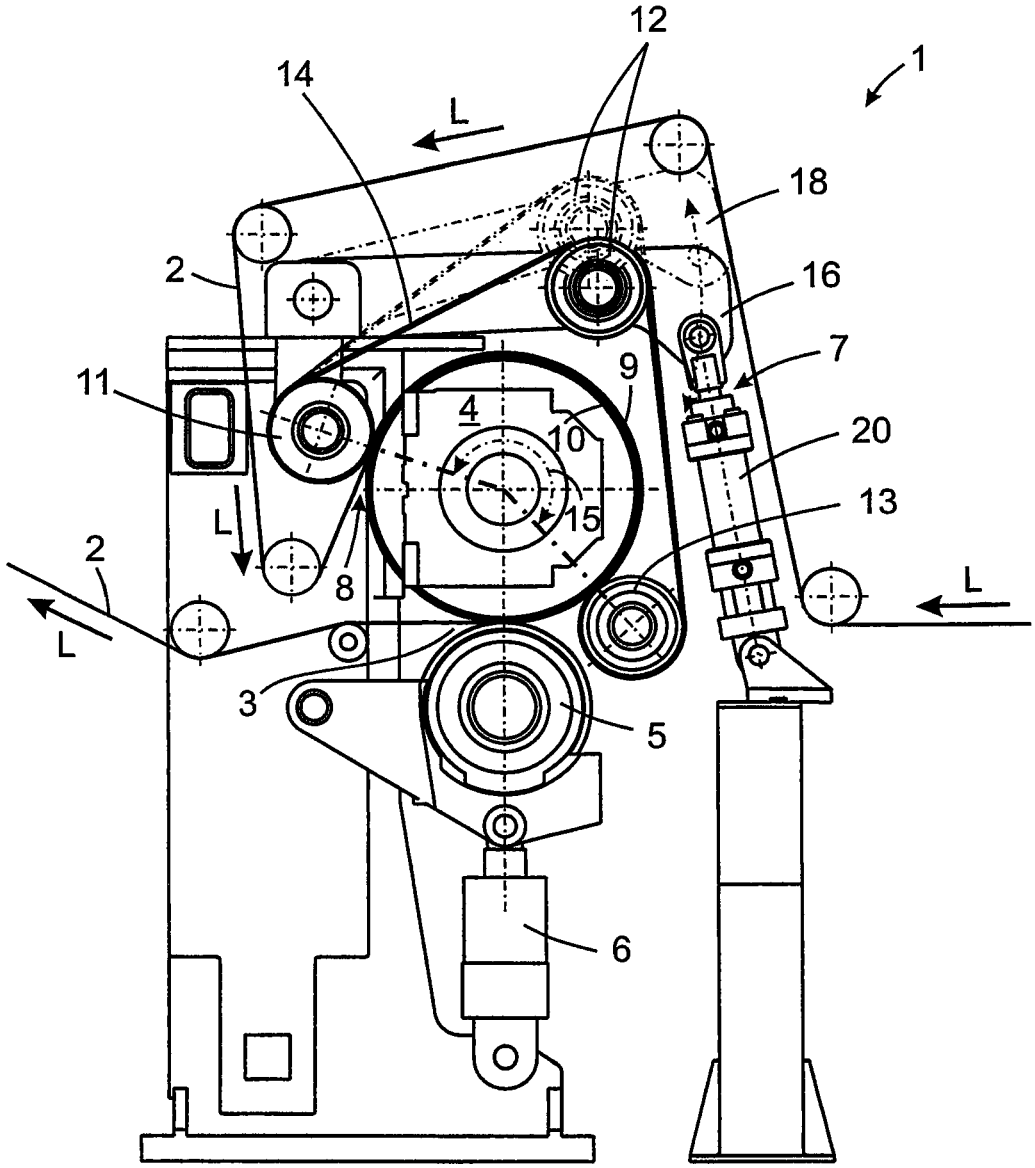
FIG. 2 shows a side view of the calender according to FIG. 1.

At least one of the guide rolls 12 has a device 16 for tensioning the belt 14 as desired. The guide roll 12 for tensioning the belt 14 is mounted at the ends in each case by means of a guide 18 such that it can be displaced or pivoted. FIG. 2 shows a lever system as guide 18. A drive element 20, which is assigned a displacement measuring device, not illustrated, acts on the lever system.

At least one of the guide rolls 11, 13 can be constructed as a pressure roll, which presses the web in the treatment nip 8 along a section in the running direction L by means of additional radial pressure loading. One guide roll 11, 13 on the inlet and/or outlet side of the treatment nip 8 is preferably constructed as a pressure roll. The radial pressure loading can be set lower on the inlet side than on the outlet side or vice versa. Such a pressure roll can be a deflection controlled roll.

FIG. 1 and FIG. 2 show a calender 1 in which the belt 14 wraps around the heatable hard roll 4 by more than 180°. The angle 15 of wrap preferably lies at values between 90° and 270°, the values particularly preferably being greater than or equal to 120°. The circulating, endless belt 14 is led around the heatable roll 4 in a loop by three guide rolls 11, 12, 13. Here, the belt 14 is tensioned by the guide roll 12. By means of this tensioning, the contact pressure of the belt 14 on the web 2 is determined. A higher tension of the belt 14 also results in a higher contact pressure of the web 2 and benefits the evening of the web surface, i.e. the pre-calendering.

The web 2 conditioned in the treatment nip 8 is then finally calendered in a nip 3 that follows directly and is formed with the same heatable roll 4. The line load in the nip 3 can be matched to the calendering effects to be achieved. Average compressive stresses with paper or board in the nip 3 from 2 $N/mm^2$ to 55 $N/mm^2$ can be set. The compressive stresses in the lower region of the aforementioned range are used for thickness correction in the case of board. The compressive stresses in the upper region of the aforementioned range permit the calendering of high-quality papers such as SC, LWC and MWC papers or wood-free coated papers. Exact profile control is possible by means of direct pressure between the two rolls without a belt 14 being led between these two rolls 4, 5. Any thickness differences possibly present in the belt 14 on account of fabrication tolerances or thermal expansion have no effect on the calendering result.

Since the temperature of the heated roll 4 and the length of the treatment section formed under the belt 14 are set in such a way that it is substantially only the region of the web 2 close to the surface that is heated, a conditioning section is produced, in which the interior of the web 2 remains below the plasticization or glass transition temperature. As a result, volume-maintaining calendering is possible. The thickness of the layer of the web 2 which is close to the surface and which is brought above the plasticization temperature is many times the largest irregularities in the paper or board web surface. The thickness of the layer to be heated thus depends on the roughness of the web 2 to be treated. The length of the treatment nip 8 and the speed of the web 2 in the running direction L determine the dwell time of the web 2 in the treatment nip 8 and thus also the penetration depth of the heat into the web 2 and the layer thickness which is heated to a deformation temperature.

The ambient air entrained in the boundary layer with the web 2 makes the transfer of heat from the heated roll 4 to the web 2 worse. A substantial improvement in the transfer of heat is achieved by removal of the boundary layer. This can be done, for example, by means of a contact section for an adhering contact between the outer wall of the heatable roll 4 and the surface of the paper or board web 2 on the inlet side before the web treatment device 7. Also suitable is pressing a guide roll 11 against the heated roll 4. By means of these measures, the disruptive boundary layer can be displaced counter to the running direction of the web 2, and the transfer of heat in the treatment nip 8 can be increased further.

FIG. 3 shows a calender arrangement having two calenders 1 arranged one after the other in the running direction of the web 2. In this way, calendering of both sides of the web 2 is possible. In the calender arrangement shown, the lower web side is calendered first in the first calender 1 and the upper web side is then calendered in the second calender 1. The temperatures of the two heatable rolls 4 and the line loads in the two calenders 1 can be set independently of one another. As a result, the two-sidedness of the web 2, as based on the calendering result (different smoothness of the two sides of a web), can be minimized or, if desired, a specific two-sidedness can also be set. Alternatively, the upper web side can also be calendered first.

The calenders 1 according to the exemplary embodiments described can be operated online or off-line. Drives can be provided for the rolls 4. The calender 1 permits a high smoothness to be imparted to the surface of the web 2, the circulating belt 14 being stressed little both mechanically and thermally.

FIG. 4 shows a multi-nip calender for calendering high-quality papers. The treatment nip 8 is then preferably provided before the first nip. As described above, the angle of wrap 15 and the contact pressure exerted can also be varied here. The contact pressure exerted is determined via the belt tension with the aid of at least one adjustable guide roll 12. There is therefore the possibility of adaptation to different fibrous materials or different types of treatment. For the purpose of pre-heating, the web 2 can even be applied to the circumferential surface of the heatable roll 4 before the treatment nip 8.

Figure 5:
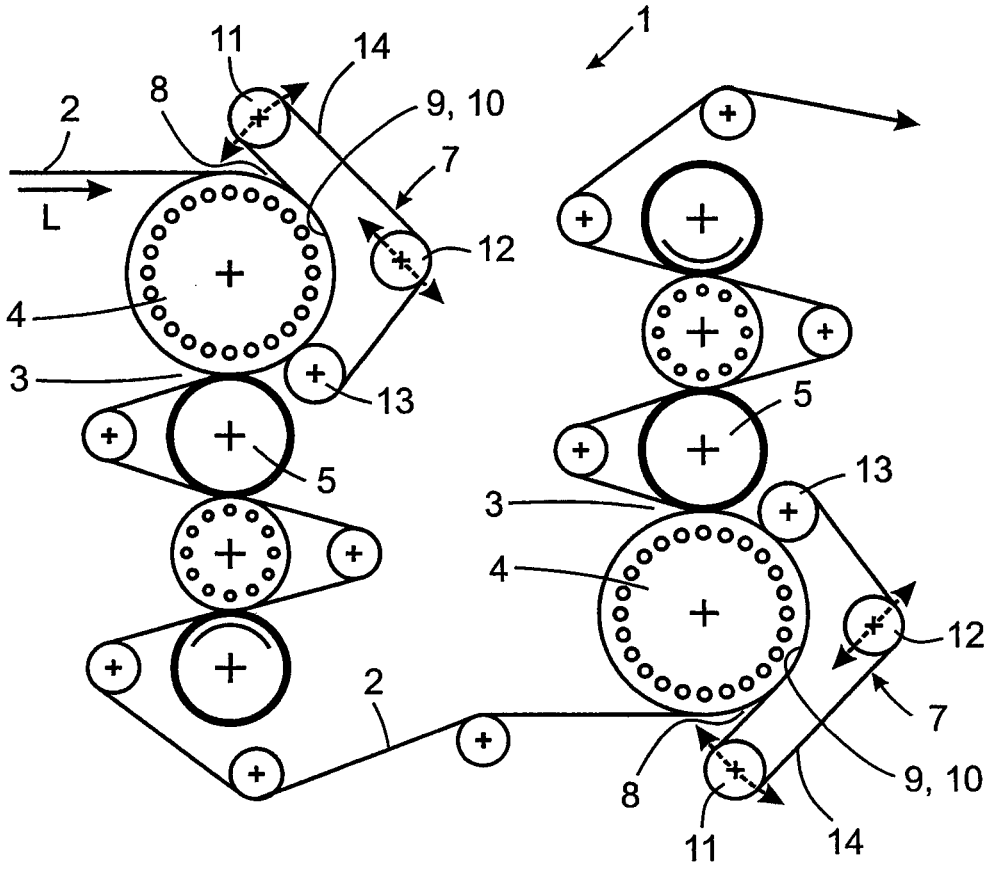
FIG. 5 shows, schematically, a calender according to a fourth exemplary embodiment.

FIG. 5 shows a multi-nip calender for calendering high-quality papers, having two roll stacks as illustrated in FIG. 4. The second stack is preferably used to calender a second side of the paper web. The end roll 4, on which the treatment nip 8 is formed, is now the bottom end roll. Otherwise, the above explanations apply in a corresponding way.

According to an exemplary embodiment that is not shown, for a straight run of the belt the guides on both sides of a control roll can be set up such that they can be controlled in relation to each other via a sensor device provided transversely with respect to the running direction of the belt. The sensor device detects the position of the belt 14 in relation to the centre of the heatable roll 4.

The invention claimed is:

1. Calender for calendering a paper or board web, having at least one nip, which is formed between a heatable roll and a mating element, a device for producing a predetermined pressure in the nip, and a web treatment device arranged upstream of the nip and having two contact surfaces forming a treatment nip, one of which is a circulating contact surface which is formed by a belt circulating on guide rolls, the other contact surface is formed by the circulating surface of the heatable roll, and the treatment nip extends along an angle of the wrap of the heatable roll, wherein, in order to increase the thermal efficiency of the transfer of heat, the circulating belt uses a resilient surface to press the paper or board web onto the heatable roll, and the guide rolls control sectional forces of the circulating belt in the treatment nip.

2. Calender according to claim 1, wherein the circulating belt has a resilient surface, which has a closed surface cover, on the side facing the paper or board web.

3. Calender according to claim 1, wherein the circulating belt has a resilient surface, which forms a thermal insulator delimiting the treatment nip, on the side facing the paper or board web.

4. Calender according to claim 1, wherein the resilient surface consists of a material having a thermal conductivity of less than or equal to 10 W/mK.

5. Calender according to claim 4, wherein the resilient surface consists of a material having a thermal conductivity of less than or equal to 1 W/mK.

6. Calender according to claim 1, wherein the angle of wrap for adjusting the length of the treatment nip can be set as a function of a penetration depth of the heat into the paper or board web.

7. Calender according to claim 1, wherein the mating element is a soft roll, the diameter of which is less than or equal to 90% of the diameter of the heatable roll.

8. Calender according to claim 1, wherein the circulating belt has a resilient surface of a plastic having a hardness in the range from 50 Shore A to 92 Shore D.

9. Calender according to claim 1, wherein at least one of the guide rolls has a device for tensioning of the belt as desired.

10. Calender according to claim 9, wherein the guide roll for tensioning the belt is mounted at the ends in each case by means of a guide such that it can be displaced or pivoted.

11. Calender according to claim 10, wherein, for a straight run of the belt, the guides can be adjustable in relation to each other via a sensor device provided transversely with respect to the running direction of the belt.

12. Calender according to claim 1, wherein at least one guide roll is constructed as a pressure roll which presses the web in the treatment nip along a section in the running direction by means of the use of additional radial pressure.

13. Calender according to claim 1, wherein a contact section for adhering contact between the outer wall of the heatable roll and the surface of the paper or board web is arranged upstream on the inlet side of the web treatment device.

14. Calender according to claim 1, wherein the calender is a multi-nip calender, which provides the treatment nip before the first nip.

15. Calender according to claim 1, wherein the nip is a soft or hard nip, which has a nip length in a range from 1 to 40 mm.

16. A calender for calendering a paper or board web, comprising:

a heatable roll that is configured to heat a surface of the heatable roll;

a mating element that is configured to be placed opposite the heatable roll, wherein the heatable roll and the mating element form a calendering nip;

a device for producing a desired pressure in the calendering nip, a web treatment device positioned upstream of the calendering nip and having two contact surfaces forming a treatment nip, wherein one of the contact surfaces comprises a circulating contact surface which is formed by a belt circulating on guide rolls, and the other contact surface is formed by the circulating surface of the heatable roll;

wherein the treatment nip extends along an angle of the wrap of the heatable roll, wherein in order to increase the thermal efficiency of the transfer of heat, the circulating belt comprises a resilient surface to press the paper or board web onto the heatable roll, and the guide rolls control sectional forces of the circulating belt in the treatment nip.

17. A calender as in claim 16, wherein the paper or board web is configured to be first fed into the treatment nip where the paper or board web passes between the web treatment belt and the heatable roll such that the paper or board web is heated by the heatable roll prior to entering the calendering nip.

18. A calender as in claim 16, wherein the belt comprises a thermal insulator that functions as a thermal shield to hinder heat transfer originating in the heatable roll to the surroundings to thereby enhance heat transfer into the paper or board web.

19. A calender as in claim 16, wherein the heatable roll is configured to heat the surface to a temperature higher than a plasticization temperature of the paper or board web at a selected moisture content.

20. A calender as in claim 19, wherein the heatable roll is configured to heat the surface to a temperature in the range from 80 degrees C. to 160 degrees C.

21. A calender as in claim 16, wherein the belt comprises a carrier material having a resilient layer.

22. A calender as in claim 21, wherein the carrier material comprises a metal and the resilient layer comprises a plastic.

* * * * *